United States Patent [19]

Iwanaga et al.

[11] Patent Number: 5,051,138

[45] Date of Patent: Sep. 24, 1991

[54] METHOD OF PRODUCING GRAIN ORIENTED ELECTRICAL STEEL SHEET HAVING HIGH MAGNETIC FLUX

[75] Inventors: Isao Iwanaga; Kenzo Iwayama, both of Kitakyushu, Japan

[73] Assignee: Nippon Steel Corporation, Tokyo, Japan

[21] Appl. No.: 501,601

[22] Filed: Mar. 29, 1990

[30] Foreign Application Priority Data

Mar. 30, 1989 [JP] Japan ..... 1-79988

[51] Int. Cl.[5] ..... C21D 8/02

[52] U.S. Cl. ..... 148/2; 148/12 F

[58] Field of Search ..... 148/2, 12 F, 308

[56] References Cited

U.S. PATENT DOCUMENTS

| | | | |
|---|---|---|---|
| 3,941,623 | 3/1976 | Takashima et al. | 148/308 |
| 4,171,994 | 10/1979 | Miller, Jr. | 148/308 |
| 4,225,366 | 9/1980 | Harase et al. | 148/113 |

FOREIGN PATENT DOCUMENTS

| | | |
|---|---|---|
| 54-83620 | 7/1978 | Japan . |
| 53-97923 | 8/1978 | Japan . |
| 59-190326 | 10/1984 | Japan . |
| 61-238939 | 10/1986 | Japan . |
| 63-11619 | 1/1988 | Japan . |
| 63-176427 | 7/1988 | Japan . |
| 64-229 | 1/1989 | Japan . |

*Primary Examiner*—Deborah Yee

*Attorney, Agent, or Firm*—Kenyon & Kenyon

[57] ABSTRACT

A method of producing a grain oriented electrical steel sheet having a high magnetic flux density comprises the steps of continuously rapid quench solidifying a molten steel essentially consisting of 0.03 to 0.10% of C, 2.5 to 4.5% of Si, 0.02 to 0.15% of Mn, 0.01 to 0.04% of Al acid soluble by weight and the remainder substantially Fe, to obtain a thin strip, subjecting the thin strip to cold rolling one or two or more stages, with an annealing therebetween, decarburization annealing, and finishing annealing wherein the content of S in the molten steel is 0.01% or less the content of N in the molten steel is 0.003% or less, and sulfide and nitride are contained in the annealing separator for the finishing annealing.

7 Claims, No Drawings

METHOD OF PRODUCING GRAIN ORIENTED ELECTRICAL STEEL SHEET HAVING HIGH MAGNETIC FLUX

BACKGROUND OF THE INVENTION

1. Field of the Invention

The present invention relates to a method of producing a grain oriented electrical steel sheet having a high magnetic flux and made from a thin strip casting method containing 2.5 to 4.5% by weight of Si.

2. Description of the Related Art

A grain oriented electrical steel sheet is used as an iron core material of an electrical apparatus such as a transformer etc. and thus the electrical steel sheet requires an improved excited property and watt loss as inherent magnetic properties thereof.

Further, the commercial requirements for a low watt loss material having a small energy loss have recently increased.

In the conventional production method of producing the grain oriented steel sheet, however, complex processes or treatments such as a hot rolling, cold rolling, and annealing, etc. must be used with the result that the production cost, become very expensive.

Accordingly, a technique whereby the molten electrical steel is directly worked to a thin strip by a quench solidification process has been developed, and according to this process, since a product or a semiproduct can be made from a molten steel, the production costs can be greatly reduced. There are two well known methods of producing a grain oriented electrical steel sheet by using the quench solidification process.

In the method as disclosed in Japanese Unexamined Patent Publication (Kokai) No. 59-190326, a surface energy called tertial recrystallization is used, but in this method, to generate the tertial recrystallization having {110}<001> orientation in the longitudinal direction, an annealing in vacuum or a high purity $H_2$ atmosphere is required, and thus the method is not easily used in an industrial scale. Further a strip having a large thickness can not be obtained, and thus the strip obtained by the method is limited to one having a very thin thickness. In the other well known method an inhibitor is used in the same manner as in a conventional hot rolling process.

This second method, in which a hot rolling is completely omitted is disclosed, for example, Japanese Unexamined Patent Publications (Kokai) Nos. 53-97923, 54-83620, 61-238939, 63-11619, 63-176427, 64-229, etc.

In these publications, AlN, MnS, MnSe, BN, Sb etc. are proposed as inhibitors, but the inventors found that, when the hot rolling process is completely omitted and replaced by a quench solidification process, even if the secondary cooling rate, i.e., the cooling rate of the solidified strip, is made 10° C./sec or more a coarse precipitate having a size of 0.1 to 1.0 μm is often generated in the conventional oriented electrical molten steel compositions, and the above-mentioned inhibitors are not sufficiently reacted.

SUMMARY OF THE INVENTION

An object of the present invention is to provide a low cost method of producing a grain oriented electrical steel sheet having improved magnetic properties by enhancing the effects of the inhibitor in the quench solidification process. Accordingly there is provided method of producing a grain oriented electrical steel sheet having a high magnetic flux density, comprising steps of continuously rapid quench solidifying a molten steel essentially consisting of 0.03 to 0.10% of C, 2.5 to 4.5% Si 0.02 to 0.15% of Mn, 0.01 to 0.04% of acid soluble Al, by weight and the remainder substantial Fe, to obtain a thin strip which is subjected to cold rolling one or two or more stages, with an annealing therebetween, decarburization annealing, and finishing annealing wherein the content of S is 0.01% or less and the content of N is 0.003% or less, in the molten steel, and sulfide and nitride are contained in the annealing separator in the finishing annealing.

Further, according to the present invention there is provided a method of producing a grain oriented electrical steel sheet having a high magnetic flux density, comprising steps of continuously rapid quench solidifying a molten steel essentially consisting of C 0.03 to 0.10% 2.5 to 4.5% Si, 0.02 to 0.15% of Mn, 0.01 to 0.04% of acid soluble Al by weight and remainder substantially Fe, to obtain a thin strip which is then subjected to a cold rolling one or two or more stages, with an annealing therebetween, decarburization annealing, and finishing annealing wherein the content of S is 0.01% or less, and the content of N is 0.003% or less, sulfide is contained in the annealing separator in the finishing annealing, and the $N_2$ partial pressure in the annealing atmosphere before the recrystallization is enhanced. There is further provided method of producing a grain oriented electrical steel sheet having a high magnetic flux density, comprising steps of continuously rapid quench solidifying a molten steel essentially consisting of 0.03 to 0.10% of C, 2.5 to 4.5% of Si, 0.02 to 0.15% of Mn, 0.01 to 0.04% of Al acid soluble by weight and remainder substantial Fe, to obtain a thin strip which is then subjected to a cold rolling one or two or more stages, with annealing therebetween, decarburization annealing, and finishing annealing wherein the content of S in the molten steel is 0.01% to 0.05%, the content of N in the molten steel is 0.003% or less, and a nitride is contained in the annealing separator of the finishing annealing.

There is still further provided a method of producing a grain oriented electrical steel sheet having a high magnetic flux density, comprising steps of continuously rapid quench solidifying a molten steel essentially consisting of 0.03 to 0.10% of C, 2.5 to 4.5% of Si, 0.02 to 0.15% of Mn, 0.01 to 0.04% of Al acid soluble by weight and the remainder substantially Fe, to obtain a thin strip which is then subjected to a cold rolling one or two or more stages, with annealing therebetween, decarburization annealing, and finishing annealing wherein the content of S in the molten steel is 0.01 to 0.05%, the content of N in the molten steel is 0.03% or less, and the $N_2$ partial pressure in the annealing atmosphere before the recrystallization is enhanced. Also, according to the present invention there is provided a method of producing a grain oriented electrical steel sheet having a high magnetic flux density, comprising steps of continuously rapid quench solidifying a molten steel essentially consisting of 0.03 to 0.10% of C, 2.5 to 4.5% of Si, 0.02 to 0.15% of Mn, 0.01 to 0.04% of Al acid soluble by weight and the remainder Fe, to obtain a thin strip which is then subjected to a cold rolling one or two or more stages, with annealing therebetween, decarburization annealing, and finishing annealing wherein the content of S in the molten steel is 0.01% or less, the content of N in the molten steel is 0.003 to 0.015%, and a sulfide is contained in the annealing separator in the finishing annealing.

DESCRIPTION OF THE PREFERRED EMBODIMENTS

The preferred embodiments of the present invention will now be explained in detail. As explained above, the present inventors found that, when a hot rolling process is completely omitted and replaced by a rapid quench solidification process, even if the secondary cooling rate is made to 10° C./sec or more a coarse precipitate having a size of 0.1 to 1.0 μm is often generated in the conventional oriented electrical molten steel compositions, and the above-mentioned inhibitors are not sufficiently reacted.

The mechanism of this phenomenon is not clear, but it is assumed that, since in comparison with the hot rolled strip produced by the conventional hot rolling the strip produced by the present invention has a remarkably small site of precipitation due to without hot rolling stage and has large size of crystal, the secondary recrystallization become unstable, because of poor inhibitors and poor primary structure and thus a high reduction ratio of the cold rolling cannot be adopted and a high magnetic flux density property cannot be obtained.

Nevertheless, when the molten steel of a grain oriented electrical steel containing 0.01% or less of S and 0.003% or less of N is used, the precipitation in the obtained strip, and the coarsening of the obtained precipitated product, are prevented. In the this case, even if the reduction ratio of the cold rolling is increased, the effect of the inhibitor can be enhanced by introducing the S and N in a later process, the secondary recrystallization can be stabilized even at the above-mentioned high reduction ratio, and thus the magnetic flux density can be improved.

The reasons for the restrictions in the steel compositions and the production conditions according to the present invention will be explained in detail.

As a starting material a strip produced by continuously quench solidifying molten steel containing 0.03 to 0.1% of C, 2.5 to 4.5% of Si, 0.02 to 0.15% of Mn, 0.01% or less of S, 0.01 to 0.04% of acid soluble Al, 0.003% or less of N, and the remainder of Fe is used.

The lower limit of C is made 0.03%, so that the $\gamma$ phase is properly generated and the precipitated product is finely disposed. The upper limit of C is made 0.1%, so that a high C is obtained as far as the decarburization can be effected.

Further, to obtain a high watt loss, the lower limit of Si is made to 2.5%. On the other hand, the upper limit of Si is made 4.5%, to prevent cracks, etc., and enhance the workability during cold rolling.

Other elements such as Mn, S, Al N are impurities which are used as a precipitated dispersion phase for the secondary recrystallization, and must be contained to obtain a proper reaction.

Furthermore, according to the present invention, by making the upper limit of the content of S and N in molten steel 0.01% or less and 0.003% or less, respectively, the coarsening of the precipitated products in the strip can be prevented.

Further, by making the Mn content 0.02 to 0.1%, and the acid soluble Al content 0.01 to 0.04%, in the molten steel, a secondary recrystallization having a high, precipitation can be obtained.

In the present invention, to obtain a proper reaction of the inhibitor, at least one of Cu, Sn and Sb are added to a total amount of 1.0% or less.

According to the present invention, after an annealing at a temperature of 950° to 1200° C. for 30 sec. to 30 min., if necessary, a one-time cold rolling having a finishing reduction ratio of 80% or more, or one or more times cold rolling, with an annealing therebetween, is carried out.

Then, after applying an annealing separator such as MgO to the cold rolled strip, when a finishing annealing at a temperature of 1100° C. or more is carried out to secondary recrystallize and purity the steel, the sulfide and/or the nitride are contained in the annealing separator or $N_2$ is contained in the annealing atmosphere before the secondary recrystallization, with the result that a grain oriented electrical steel sheet having a required magnetic flux density is produced.

The amount of sulfide is preferably from 50 to 2000 mg/m$^2$ in the converted value to the amount of S at a single-side of the sheet.

Preferably the annealing atmosphere is 1% or more $N_2$ and the remainder $H_2$. By containing nitride in the annealing separator, the effects of the inhibitors are enhanced. Examples of the present invention will now be explained.

EXAMPLE 1

A molten steel containing the steel compositions shown in Table 1 was applied to a twin roll and a thin strip having a thickness of 2.4 mm was produced.

Then an annealing was carried out at a temperature of 1050° C. for 5 min and thereafter, the strip was a pickled and cold rolling was carried out to obtain a very thin strip having a thickness of 0.30 mm.

TABLE 1

| | Chemical Composition (wt %) | | | | | | |
|---|---|---|---|---|---|---|---|
| Steel | C | Si | Mn | P | S | sol.Al | N |
| A | 0.057 | 3.02 | 0.074 | 0.007 | 0.004 | 0.027 | 0.0024 |
| B | 0.058 | 3.00 | 0.077 | 0.006 | 0.026 | 0.025 | 0.0015 |
| C | 0.055 | 2.99 | 0.078 | 0.007 | 0.027 | 0.025 | 0.0076 |

The strip then was decarburization-annealed in wet hydrogen, and thereafter, an annealing separator mainly composed of MgO was applied. Note 0.6% of $MgSO_4$ in an S converted value was added to the annealing separator only in the case of the steel A. Further, when a high temperature is carried out at a temperature of 1200° C. for 10 hours in a hydrogen gas atmosphere, the conditions of the atmosphere gas during a heating process to the temperature of 1200° C. were as follows.

Steels A and B: 75% $N_2$+25% $H_2$

Steel C: 15% $N_2$+85% $H_2$

The magnetic flux densities of the obtained sheets are shown in Table 2.

As shown in Table 2, in the present invention, higher magnetic properties than found in the conventional process were obtained.

TABLE 2

| Steel | Magnetic flux density $B_{10}$(T) | |
|---|---|---|
| A | 1.94 | Invention |
| B | 1.91 | Invention |
| C | 1.89 | Conventional Process |

EXAMPLE 2

A molten steel containing the steel compositions shown in Table 3 was applied to a twin roll and a thin strip having a thickness of 2.1 mm was produced.

Then an annealing was carried out at a temperature of 1050° C. for 5 min., and thereafter, the strip was pickled and cold rolling was carried out to obtain a very thin strip having a thickness of 0.22 mm.

The strip was then decarburization-annealed in wet hydrogen, and thereafter, an annealing separator mainly composed of MgO was applied. Note, 0.5% of $MgSO_4$ in an S converted value was added to the annealing separator only in the case of the steels D and F.

Further, when a high temperature is carried out at a temperature of 1200° C. for 10 hours in a hydrogen gas atmosphere, the conditions of the atmosphere gas during heating process to the temperature of 1200° C. were 15% $N_2$+85% $H_2$ in all steels.

The magnetic flux densities of the obtained sheets are shown in a Table 4.

As shown in the Table 4, in the present invention, higher magnetic properties than found in the conventional process were obtained.

TABLE 3

| | Chemical composition (wt %) | | | | | | | | |
|---|---|---|---|---|---|---|---|---|---|
| Steel | C | Si | Mn | P | S | sol.Al | N | Cu | Sn |
| D | 0.051 | 3.22 | 0.075 | 0.005 | 0.006 | 0.024 | 0.0017 | 0.09 | 0.11 |
| E | 0.056 | 3.17 | 0.071 | 0.007 | 0.022 | 0.028 | 0.0025 | 0.10 | 0.09 |
| F | 0.055 | 3.14 | 0.076 | 0.005 | 0.005 | 0.022 | 0.0075 | 0.09 | 0.08 |
| G | 0.056 | 3.19 | 0.076 | 0.009 | 0.026 | 0.025 | 0.0078 | 0.09 | 0.09 |

TABLE 4

| Steel | Magnetic flux density $B_{10}$(T) | |
|---|---|---|
| D | 1.95 | Present Invention |
| E | 1.92 | present Invention |
| F | 1.93 | Present Invention |
| G | 1.90 | Conventional Process |

We claim:

1. A method of producing a grain oriented electrical steel sheet having a high magnetic flux density, comprising steps of continuously rapid quench solidifying a molten steel essentially consisting of 0.03 to 0.10% of C, 2.5 to 4.5% of Si, 0.02 to 0.15% of Mn, 0.01 to 0.04% of Al acid soluble by weight and the remainder substantially Fe, to obtain a thin strip, subjecting said thin strip to a cold rolling one or two or more stages, with an annealing therebetween, without hot rolling prior to cold rolling, decarburization annealing, applying an annealing separator prior to finishing annealing, and finishing annealing, wherein a content of S of 0.01% or less, and a content of N of 0.003% or less is contained in the molten steel, and sulfide and nitride are contained in the annealing separator for the finishing annealing.

2. A method of producing a grain oriented electrical steel sheet having a high magnetic flux density, comprising steps of continuously rapid quench solidifying a molten steel essentially consisting of 0.03 to 0.10% of C, 2.5 to 4.5% of Si, 0.02 to 0.15% of Mn, 0.01 to 0.04% of Al acid soluble by weight and the remainder substantially Fe, to obtain a thin strip, subjecting said thin strip to cold rolling one or two stages, with an annealing therebetween, without hot rolling prior to cold rolling, decarburization annealing, applying an annealing separator prior to finishing annealing, and finishing annealing wherein the content of S in the molten steel is 0.01% or less and the content of N in the molten steel is 0.003% or less, sulfide is contained in the annealing separator for said finishing annealing, and providing an annealing atmosphere for the finishing annealing wherein said atmosphere contains $N_2$ prior to recrystallization.

3. A method of producing a grain oriented electrical steel sheet having a high magnetic flux density comprising steps of continuously rapid quench solidifying a molten steel essentially consisting of 0.03 to 0.10% of C, 2.5 to 4.5% of Si, 0.02 to 0.15% of Mn, 0.01 to 0.04% of Al acid soluble by weight and the remainder substantially Fe, to obtain a thin strip, subjecting said thin strip to cold rolling one or two or more stages, with an annealing therebetween, without hot rolling prior to cold rolling, decarburization annealing, applying an annealing separator prior to finishing annealing, and finishing annealing wherein the content of S in the molten steel is 0.01 to 0.05%, the content of N in the molten steel is 0.003% or less, and a nitride is contained in the annealing separator for the finishing annealing.

4. A method of producing a grain oriented electrical steel sheet having a high magnetic flux density comprising steps of continuously rapid quench solidifying a molten steel essentially consisting of 0.03 to 0.10% of C, 2.5 to 4.5% of Si, 0.02 to 0.15% of Mn, 0.01 to 0.04% of Al acid soluble by weight and the remainder substantially Fe, to obtain a thin strip, subjecting said thin strip to cold rolling one or two or more stages, with an annealing therebetween, without hot rolling prior to cold rolling, decarburization annealing, applying an annealing separator prior to finishing annealing, and finishing annealing wherein the content of S in the molten steel is 0.01 to 0.05%, the content of N in the molten steel is 0.003% or less, and providing an annealing atmosphere for the finish annealing wherein said atmosphere contains $N_2$ prior to recrystallization.

5. A method of producing a grain oriented electrical steel sheet having a high magnetic flux density comprising steps of continuously rapid quench solidifying a molten steel essentially consisting of 0.03 to 0.10% of C, 2.5 to 4.5% of Si, 0.02 to 0.15% of Mn, 0.01 to 0.04% of Al acid soluble by weight and the remainder substantially Fe, to obtain a thin strip, subjecting said thin strip to cold rolling one or two or more stages, with an annealing therebetween, without hot rolling prior to cold rolling, decarburization annealing, applying an annealing separator prior to finishing annealing, and finishing annealing wherein the content of S in the molten steel is 0.01 or less and the content of N in the molten steel is 0.003 to 0.015%, and a sulfide is contained in the annealing separator for said finishing annealing.

6. A method according to any one of claims 1 to 5 further comprising the step of annealing said thin strip prior to cold rolling.

7. A method according to any one of claims 1 to 5 further comprising the step of providing said molten steel with at least one member selected from the group consisting of Cu, Sn, and Sb in a total amount of 1.0% or less by weight.

* * * * *